United States Patent [19]

Inglis et al.

[11] 4,385,728

[45] May 31, 1983

[54] FLOW-AMPLIFYING NOZZLE

[75] Inventors: Leslie R. Inglis; Joseph E. Peter, both of Cincinnati, Ohio

[73] Assignee: Vortec Corporation, Cincinnati, Ohio

[21] Appl. No.: 230,012

[22] Filed: Jan. 30, 1981

[51] Int. Cl.[3] ..... B05B 1/06; B05B 1/30

[52] U.S. Cl. ..... 239/424; 239/433; 239/600; 239/DIG. 21

[58] Field of Search ..... 239/424, 424.5, 425, 239/433, 434.5, 600, DIG. 7, DIG. 21, DIG. 22; 417/151, 197, 198; 15/408, 405, 300 R, 415 R

[56] References Cited

U.S. PATENT DOCUMENTS

| | | | |
|---|---|---|---|
| 3,743,186 | 7/1973 | Mocarski | 239/433 X |
| 3,795,367 | 3/1974 | Mocarski | 239/DIG. 7 X |
| 3,801,020 | 4/1974 | Mocarski | 239/DIG. 7 X |
| 3,806,039 | 4/1974 | Mocarski | 239/433 X |
| 3,984,054 | 10/1976 | Frochaux | 239/424 |
| 4,046,492 | 9/1977 | Inglis | 417/197 |
| 4,195,780 | 4/1980 | Inglis | 239/433 X |

FOREIGN PATENT DOCUMENTS

| | | | |
|---|---|---|---|
| 785721 | 8/1935 | France | 239/434.5 |

*Primary Examiner*—Andres Kashnikow

*Attorney, Agent, or Firm*—Tilton, Fallon, Lungmus

[57] ABSTRACT

A flow-amplifying nozzle having a construction which facilitates production, reduces costs, and enhances the safety of such a nozzle in operation. Such construction is particularly suitable for relatively small-size nozzles designed to direct and amplify the flow of compressed air or other pressurized fluid. The nozzle is composed of two pieces, one being a rigid tube having a closed, tapered nose portion and a plurality of radial openings in the cylindrical portion immediately adjacent the nose, and the other being a collar extending about and secured to the tube's cylindrical portion. The collar redirects the flow of fluid discharged through the radial openings, causing it to be expelled forwardly over the tapered nose of the nozzle. Secondary air is entrained by the rapid flow of primary air and thereby amplifies the total flow of air directed by the nozzle.

8 Claims, 4 Drawing Figures

FLOW-AMPLIFYING NOZZLE

BACKGROUND

Co-owned U.S. Pat. No. 4,195,780 discloses an external flow-amplifying nozzle in which a tapered nozzle section is adjustably mounted upon a body section. The parts are constructed to provide a metering passage which extends radially outwardly between a pair of opposing transverse surfaces provided by the respective parts. The metering passage merges with a forwardly-facing flow-directing passage of annular configuration. Fluid under pressure discharged from the flow-directing passage travels forwardly along the outer surface of the tapered nozzle section. Such primary air, escaping at high velocity from the nozzle, entrains large quantities of secondary air surrounding the nozzle, drawing such secondary air forwardly. The flow from the nozzle is thereby amplified to create a total flow which is substantially greater than the flow of primary air alone.

The commercial version of the nozzle disclosed in U.S. Pat. No. 4,195,780 is widely known and used in industry for cleaning, drying, and convective cooling. Such a nozzle is dimensioned for attachment to conventional air hoses and rigid pressure lines. In a substantial proportion of the nozzle's applications, the adjustability of such a nozzle is a significant advantage.

There are, however, situations in which nozzle adjustability is less important than minimum nozzle size. FIG. 1 depicts in generalized form a type of non-adjustable miniaturized nozzle in current use. An insert 10 has a tubular sleeve portion 11 received in tubing 12. A collar 13 fits over the tubular sleeve of the insert and is secured by solder 14 to tube 12 and sleeve 11. Air under pressure enters the nozzle through tube 12, flows outwardly through radial openings 15 in sleeve portion 11, and then travels forwardly through annular opening 16 and along the tapered outer surface of the nose or tip portion of insert 10, all as represented by the solid arrows in FIG. 1. In one form, the annular opening 16 is actually an annular series of openings separated by circumferentially spaced ribs formed as an integral part of insert 10 and engaging the inner surface of collar 13 to produce a tight frictional fit between the collar and the insert.

A disadvantage of such a construction lies in the risk that insert 10 might become loosened in use and expelled as a high-speed projectile under the force of pressurized air or other fluid, as represented by the dashed lines in FIG. 1. Although the likelihood of such expulsion would be reduced by the exercise of extreme care in establishing that at least some of the solder invades the space between the telescoping surfaces of sleeve portion 11 and tube 12, and by constructing the insert so that a press fit is developed between the outer surface of the insert and the forward end of collar 13, thereby forming the multiplicity of discharge openings described above, a risk still remains, and such risk may become magnified by operating conditions which expose such a nozzle to vibration, impact, elevated temperatures, and general abuse.

Other references illustrative of the state of the art are U.S. Pat. Nos. 3,801,020, 3,795,367, 3,806,039, 3,743,186, and 4,046,492.

SUMMARY

One aspect of this invention lies in recognizing the problem inherent in the miniaturized non-adjustable nozzle construction depicted in FIG. 1; another aspect lies in discovering an improved construction which not only overcomes the problem but which also has the further advantage of being simpler and less expensive to manufacture.

Briefly, the non-adjustable nozzle of this invention is formed of only two pieces, one being a rigid tube closed at one end to define a tapered nose or tip portion, and the other being a collar which extends about the cylindrical portion of the tube. The collar has a flow-directing section and an attachment section, the flow-directing section having a bore sufficiently greater in diameter than the outside of the supporting tube to define a flow passage leading towards the tapered nose or tip portion of the tube. A plurality of radial openings are formed within the cylindrical portion of the tube and communicate with the flow-directing passage. Direct connection between the collar and tube occurs behind the radial openings (i.e., to the side of such openings remote from the tapered nose portion), and a positive stop may be formed in the wall of the tube to prevent any possibility of rearward movement of the collar in use. There is no part that could become loosened and projected forwardly by pressurized air in use. While loosening of the collar would be highly unlikely in any event, the relationship of parts is such that pressurized air would tend to hold the collar in its operative position rather than dislodge it.

Other objects, features, and advantages of the invention will become apparent from the specification and drawings.

DRAWINGS

DETAILED DESCRIPTION

Figure 4:
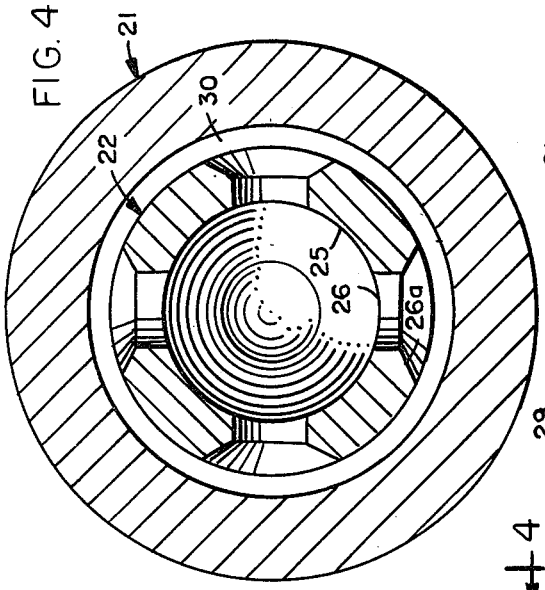
FIG. 4 is a cross sectional view taken along line 4—4 of FIG. 3.
Figure 3:
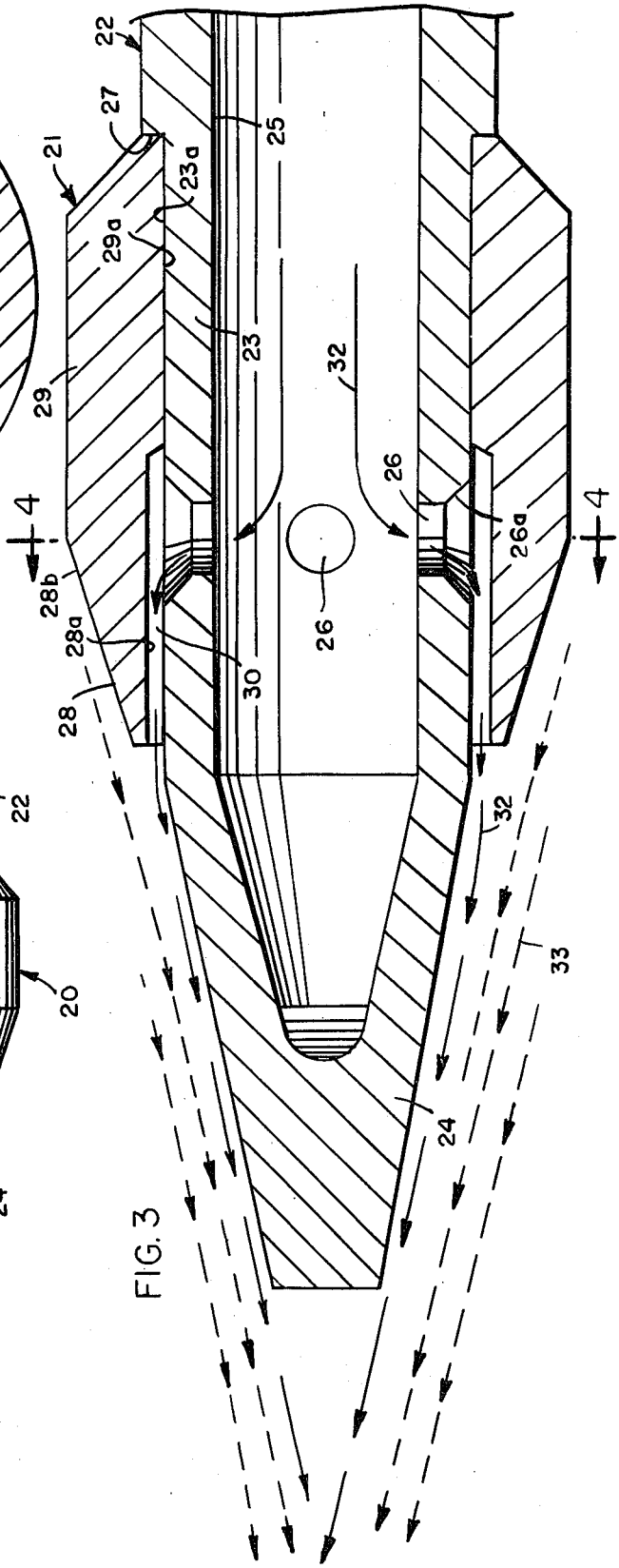
FIG. 3 is an enlarged longitudinal sectional view of the nozzle of FIG. 2.
Figure 2:
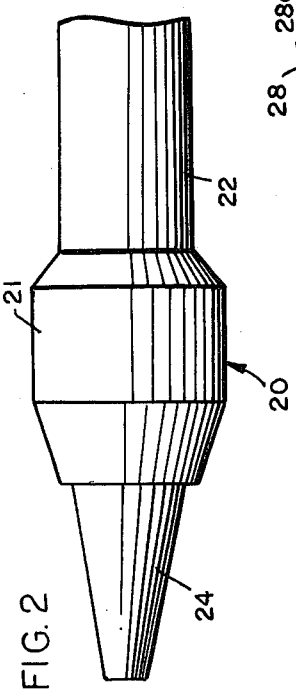
FIG. 2 is a side elevational view of a nozzle embodying the present invention.
Figure 1:
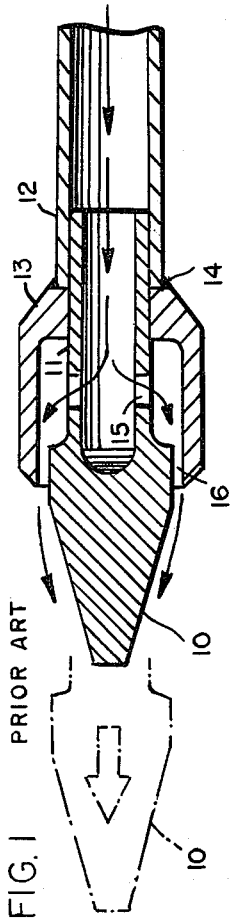
FIG. 1 is a somewhat schematic longitudinal sectional view of a prior art nozzle.

Referring to FIGS. 2–4, the numeral 20 generally designates a nozzle formed of two pieces, specifically, an outer collar 21 and an inner tube 22 upon which the collar is mounted. The tube has a proximal cylindrical portion 23 and a distal (or forwardly-disposed) conical nose or tip portion 24. An axial passage 25 extends through the tube and, as shown in FIG. 3, may even project into conical nose portion 24. It is to be noted that the nose portion is integral with the rest of the tube. Although the tapered end of the nose is closed during manufacture by a reforming operation performed on standard uniform-bore rigid tubing of copper, brass, aluminum, or other malleable material, it is not essential that the tube be completely closed at its extremity. Also, while metal is a preferred fabricating material because of its strength and durability, other materials such as rigid plastics may be used to form both the tube 22 and collar 21.

The cylindrical portion 23 of the tube 22 is provided with a plurality of circumferentially-spaced radial openings 26. Four such openings are illustrated in the drawings; however, a greater or smaller number may be provided. The number and size of such openings controls the rate of flow of fluid from the nozzle and the openings, taken in the aggregate, therefore perform a function similar to that of the metering passage 30 disclosed in U.S. Pat. No. 4,195,780. The cylindrical portion 23 of the tube is provided with an outwardly projecting annular shoulder 27 at a point spaced well behind (or proximal to) metering openings 26. From shoulder 27, the tube 22 continues rearwardly and is connected by any suitable means to a source of fluid under pressure.

Collar 21 has a front (or distal) flow-directing section 28 and a rear (or proximal) attachment section 29. The inside diameter of the attachment section 29 is essentially the same as the outside diameter of the tube's cylindrical portion 23 in front of shoulder 27; hence, an interference fit is provided between the parts when they are assembled as shown in FIG. 3. Supplemental attachment means may also be provided. For example, the opposing surfaces 29*a* and 23*a* of the collar and tube, respectively, may be joined by solder, compressive deformation, or any other suitable means. Where plastic is used, such surfaces may be solvent-bonded, heat fused, or adhesively secured. The parts may also be threaded together, with such threads extending along what is shown as an annular interface between surfaces 23*a* and 29*a*.

The flow-directing section 28 has a bore 28*a* sufficiently greater in diameter than the outside of cylindrical portion 23 to define an annular flow passage 30 communicating with radial openings 26 and leading forwardly to the distal end of collar 21. The cross sectional area of flow passage 30 is slightly greater than the combined cross sectional areas of all of the radial openings 26. Therefore, the flow passage 30 functions as a flow-directing (or re-directing) passage and preferably performs no substantial function in controlling flow rate. As already described, flow rate is established by radial openings 26 and, because of the radial disposition of those openings, they may be easily formed and precisely dimensioned during manufacture. In the embodiment illustrated, openings 26 flare outwardly to define frusto-conical surfaces 26*a* merging with the outer surface of tube 22; such a configuration is believed to promote a smooth change in the direction of flow of pressurized fluid as it travels radially outwardly through the flow-metering openings 26 and into the annular flow-directing passage 30.

While passage 30 has been shown to be of annular configuration, it is to be understood that if desired such opening may be interrupted by one or more longitudinally-extending ribs or splines extending either from tube 22 or collar 21. Such ribs are not shown because they are optional, are known in the prior art in conjunction with nozzle construction, as described above, and would not be considered a part of this invention. When used, such ribs would serve as spacers to maintain the desired radial dimension of the flow-directing passage and as contact elements for frictionally retaining collar 21 in place on tube 22.

The front outer surface 28*b* of collar 21 is frustoconical in configuration, giving the flow-directing portion 28 a forwardly-tapered shape that promotes a smooth merger of primary and secondary air streams. Primary flow is represented in FIG. 3 by solid arrows 32, whereas the secondary air entrained by the primary flow is represented by dashed arrows 33. Reference may be had to U.S. Pat. No. 4,195,780 for a detailed explanation of the flow-amplifying operation of such a nozzle. It will be observed from FIG. 3 that there are no forces exerted by the primary flow of high-pressure fluid that would tend to urge collar 21 forwardly; in fact, the pressure of air within flow-directing passage 30 tends to force the collar rearwardly and thereby resist any opposing external forces. Since tube 22 is a unitary structure with nose portion 24 formed as an integral extension of cylindrical portion 23, and since the nozzle is a two-piece structure with the only other piece being collar 21, there is no danger that during use of the nozzle the high-pressure primary fluid might result in projectile release.

While in the foregoing we have disclosed an embodiment of this invention in considerable detail for purposes of illustration, it will be understood by those skilled in the art that many of these details may be varied without departing from the spirit and scope of the invention.

We claim:

1. A two-piece flow-amplifying nozzle, comprising an elongated one-piece rigid tube having a passage-providing cylindrical portion and a tapered nose portion integral therewith, a plurality of radial openings in said cylindrical portion, and a collar extending about said cylindrical portion and having a flow-directing section and an attachment section, said flow-directing section having a bore sufficiently greater in diameter than the outside of said cylindrical portion to define a flow-directing passage communicating with said openings and leading towards said nose portion, said attachment section being secured to said cylindrical portion in fluid-sealing relation along the surface of said cylindrical portion remote from and spaced between said nose portion and the end of said one-piece tube opposite from said nose portion.

2. The nozzle of claim 1 in which said tapered nose portion of said tube is closed.

3. The nozzle of claim 1 in which said flow-directing section and said attachment section of said collar are integrally formed.

4. The nozzle of claim 1 in which said attachment section of said collar is secured to said tube by means of an interference fit.

5. The nozzle of claim 4 in which said tube is provided with stop means for blocking movement of said collar axially away from said nose portion.

6. The nozzle of claim 5 in which said stop means comprises an annular external shoulder provided by said tube engaging said attachment section of said collar.

7. The nozzle of claim 1 in which each of said radial openings flares outwardly adjacent the outer surface of said cylindrical portion.

8. The nozzle of claim 6 in which said shoulder is provided by said cylindrical portion and is spaced axially from both said nose portion and the end of said one-piece tube opposite from said nose portion.

* * * * *